US010852000B2

(12) United States Patent
Heo et al.

(10) Patent No.: US 10,852,000 B2
(45) Date of Patent: Dec. 1, 2020

(54) CONTROL PANEL AND HOUSEHOLD APPLIANCE HAVING THE SAME

(71) Applicant: Samsung Electronics Co., Ltd., Suwon-si (KR)

(72) Inventors: Soo Hyoung Heo, Suwon-si (KR); Hyung-Jin Kim, Suwon-si (KR); Young Tae Kim, Suwon-si (KR); Kyung Hwan Lee, Suwon-si (KR); Yeong Hyeok Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 245 days.

(21) Appl. No.: 15/720,130

(22) Filed: Sep. 29, 2017

(65) Prior Publication Data

US 2018/0094819 A1 Apr. 5, 2018

(30) Foreign Application Priority Data

Oct. 5, 2016 (KR) ..... 10-2016-0128195

(51) Int. Cl.
*F24C 3/12* (2006.01)
*F24C 15/06* (2006.01)
*F24C 7/08* (2006.01)

(52) U.S. Cl.
CPC ..... *F24C 3/124* (2013.01); *F24C 7/082* (2013.01); *F24C 15/06* (2013.01)

(58) Field of Classification Search
CPC ..... F24C 3/124; F24C 15/06; F24C 7/082
See application file for complete search history.

(56) References Cited

U.S. PATENT DOCUMENTS 3,527,200 A * 9/1970 Voeke ..... F24C 3/124 126/42
3,556,624 A * 1/1971 Baltz ..... F24C 3/124 312/295
5,611,610 A * 3/1997 Katz ..... D06F 39/12 312/263
6,065,820 A 5/2000 Fleissner et al.
6,724,633 B1 4/2004 Wu
D513,153 S 12/2005 Austin et al.
(Continued)

FOREIGN PATENT DOCUMENTS

CN 202158605 3/2012
DE 10350586 6/2005
DE 102009046998 A1 * 5/2011 ..... F24C 7/082
(Continued)

OTHER PUBLICATIONS

European Communication dated Jul. 9, 2019 in European Patent Application no. 17193988.7.
(Continued)

*Primary Examiner* — Jacob J Cigna
(74) *Attorney, Agent, or Firm* — Staas & Halsey LLP

(57) ABSTRACT

A household appliance including a control panel includes a body and a control panel provided on an outer side of the body, wherein the control panel includes a first panel formed by a process of extrusion of an aluminum (Al) material and provided with at least one surface thereof exposed to an outside thereof, and a second panel provided to be coupled to the first panel and made of the same material as the first panel.

20 Claims, 8 Drawing Sheets

(56) References Cited

U.S. PATENT DOCUMENTS

| | | | | |
|---|---|---|---|---|
| 2009/0206070 | A1* | 8/2009 | Ortner | F24C 3/124 219/398 |
| 2013/0314856 | A1 | 11/2013 | Mao et al. | |

FOREIGN PATENT DOCUMENTS

| | | | | |
|---|---|---|---|---|
| EP | 1160513 | | 12/2001 | |
| EP | 1898157 | | 3/2008 | |
| GB | 2219074 | A * | 11/1989 | F24C 7/082 |
| JP | 2006-3018 | | 1/2006 | |
| KR | 10-2002-0064004 | | 8/2002 | |

OTHER PUBLICATIONS

Extended European Search Report dated Jun. 25, 2018 in European Patent Application No. 17193988.7.

* cited by examiner

CONTROL PANEL AND HOUSEHOLD APPLIANCE HAVING THE SAME

CROSS-REFERENCE TO RELATED APPLICATIONS

This application claims the benefit of Korean Patent Application No. 10-2016-0128195, filed on Oct. 5, 2016 in the Korean Intellectual Property Office, the disclosure of which is incorporated herein by reference.

BACKGROUND

1. Field

Embodiments of the present disclosure relate to a household appliance, and more particularly, to a household appliance including a control panel.

2. Description of the Related Art

Generally, household appliances, such as a washing machine, a dishwasher, an oven, and the like, include control panels configured to control the household appliances. There are a variety of household appliances having a control panel, and particularly, a cooking apparatus having a form in which a cooktop and an oven are combined will be described as an example thereof.

The control panel is a user interface provided with a plurality of buttons, a keypad, and the like to allow a user to set a desired cooking mode or various conditions necessary for cooking. The control panel also includes a display device and the like to allow the user to check a currently set cooking mode, a cooking condition, a cooking state, or the like.

The cooking apparatus includes a body in a cabinet type, a cooking chamber provided in the body, a door provided at a front surface of the body to open or close the cooking chamber. In this case, electricity or gas may be used as an energy source to heat food.

A control panel may be disposed on one side of a body of an electronic product such as a cooking apparatus or the like. A control panel of a cooking apparatus may be disposed on an upper portion of a front surface of a body.

SUMMARY

Therefore, it is an aspect of the present disclosure to provide a household appliance including a control panel.

It is another aspect of the present disclosure to provide a household appliance including a control panel formed of an aluminum material to improve durability thereof.

It is still another aspect of the present disclosure to provide a household appliance including a control panel formed of materials matching each other to improve a design thereof.

It is yet another aspect of the present disclosure to provide a household appliance capable of simplifying a method of manufacturing a control panel and reducing a production time and costs.

Additional aspects of the disclosure will be set forth in part in the description which follows and, in part, will be obvious from the description, or may be learned by practice of the disclosure.

In accordance with one aspect of the present disclosure, a household appliance includes a body and a control panel provided on an outer side of the body, wherein the control panel includes: a first panel formed by a process of extruding an aluminum (Al) material and provided with at least one surface thereof exposed to an outside thereof; and a second panel provided to be coupled to the first panel and formed of the same material as the first panel.

The first panel obtained by extruding the aluminum (Al) material may be sequentially subject to a heat treatment, a cutting process, and a computer numerical control (CNC) process, and then may be remolded.

The first panel may be molded by performing at least one process of a hairline process and an anodizing process after performing the CNC process.

The first panel may be formed by performing at least one process of an aluminum extrusion process and an aluminum bending process.

The second panel obtained by extruding the aluminum (Al) material may be sequentially subject to a heat treatment, a cutting process, and a computer numerical control (CNC) process, and then may be remolded.

The second panel may be molded by performing at least one process of a hairline process and an anodizing process after performing the CNC process.

The first panel and the second panel may be assembled through at least one method among welding, bonding, riveting, press-fitting, and screwing methods.

The first panel may include: a plurality of first installation holes formed so that levers are mounted on the first panel; and a second installation hole formed to mount a display panel on the first panel.

The first panel may further include a second panel coupler formed to be coupled to the second panel.

In accordance with another aspect of the present disclosure, a cooking apparatus includes: a body including a cooking chamber; a control panel provided on an outer side of the body, provided with at least one surface outwardly exposed, and formed by a process of extruding an aluminum (Al) material; and a control panel bracket provided to be coupled to each of end portions of the control panel and formed of the same material as the control panel.

The control panel and the control panel bracket obtained by extruding the aluminum (Al) material may be sequentially subject to a heat treatment, a cutting processing and a computer numerical control (CNC) process, and then may be remolded.

The control panel and the control panel bracket may be formed by at least one process of an aluminum extrusion process and an aluminum bending process.

The control panel may be formed by performing at least one process of a hairline process and an anodizing process after performing the CNC process.

The control panel bracket may be formed by at least one process of a hairline process and an anodizing process after performing the CNC process.

The control panel bracket may include: a bracket body; and a fixing portion formed on an end portion of the bracket body.

The control panel and the control panel bracket may be assembled through at least one method among welding, bonding, riveting, press-fitting, and screwing methods.

The control panel may include: a plurality of first installation holes formed so that levers are mounted on the first panel; and a second installation hole formed to mount a display panel on the first panel.

In accordance with another aspect of the present disclosure, a method of manufacturing a control panel includes: extruding an aluminum material to form a first panel and a second panel; performing a heat treatment on the first panel and the second panel; cutting the first panel to form a plurality of installation holes therein; performing a computer numerical control (CNC) process on the first panel and the second panel; and assembling the first panel and the second panel.

The first panel and the second panel may be formed by at least one process of a hairline process and an anodizing process.

The first panel and the second panel may be assembled through at least one method among welding, bonding, riveting, press-fitting, and screwing methods

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
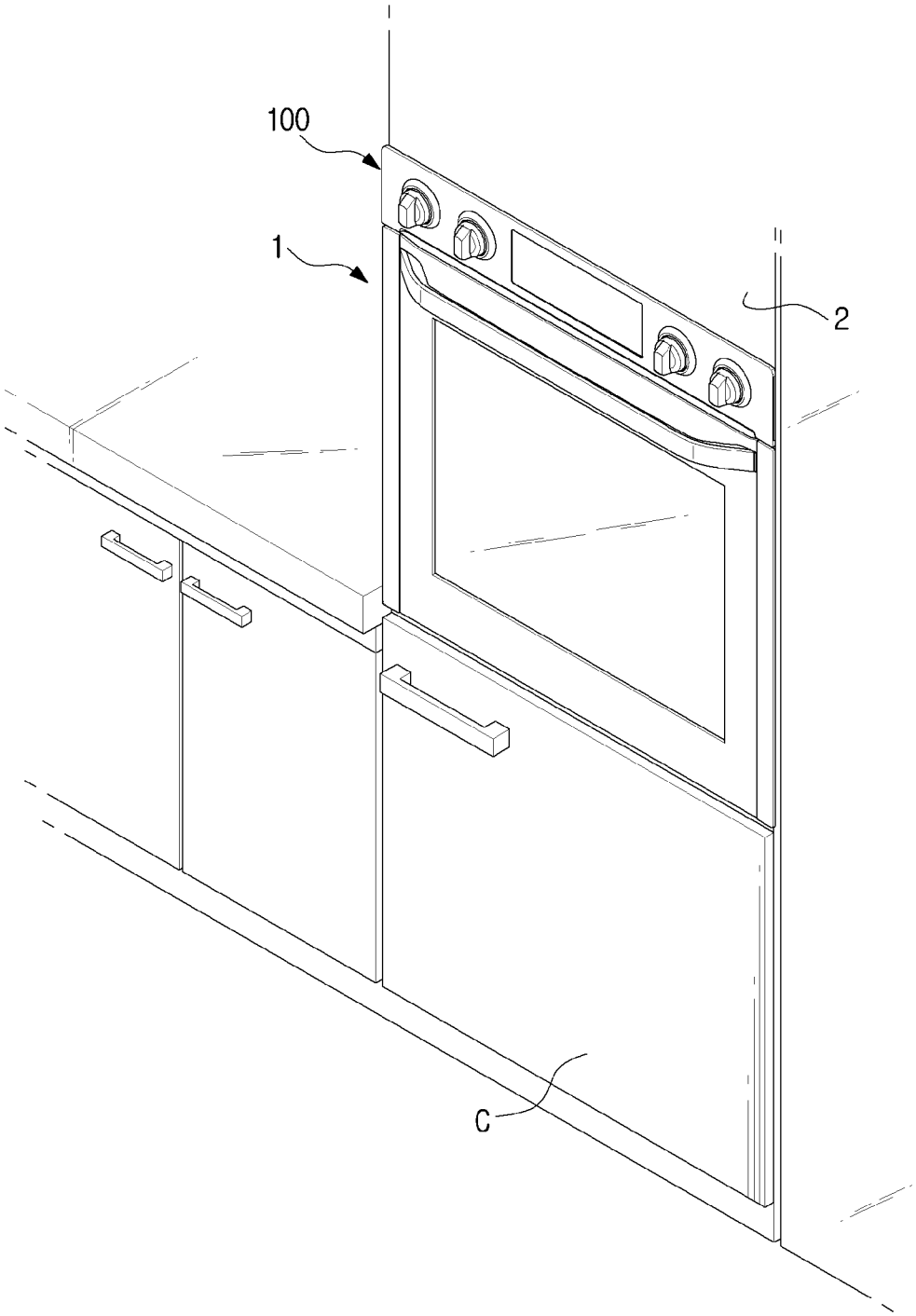
FIG. 1 is a perspective view illustrating a cooking apparatus according to one embodiment of the present disclosure.

Embodiments described in the description and configurations shown in the drawings are only one preferable example of the present disclosure, and various modifications may replace the embodiments and the drawings of the present disclosure when the present application is submitted.

Also, identical marks or numbers in the drawings of the description denote components or elements configured to perform substantially identical functions.

Also, the terminology used herein is for the purpose of describing particular embodiments only and is not intended to limit the disclosure. As used herein, the singular forms "a," "an," and "the" are intended to include the plural forms as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Also, it should be understood that, although the terms first, second, etc. may be used herein to describe various elements, these elements are not limited by these terms, and these terms are only used to distinguish one element from another. For example, a first element could be termed a second element, and, similarly, a second element could be termed a first element without departing from the scope of the present disclosure. As used here, the term "and/or" includes combinations of one or more of a plurality of associated listed items or any and all items among the plurality of associated listed items.

Hereinafter, embodiments according to the present disclosure will be described in detail with reference to the accompanying drawings. The embodiment of the present disclosure is applicable to all household appliances including control panels. A household appliance may include a cooking apparatus to which a control panel is applied. The household appliance may refer to the cooking apparatus.

The control panel may include a user interface provided with a plurality of buttons, a keypad, or the like so that a user may set various conditions of a product.

Hereinafter, the cooking apparatus will be described as one example.

A front surface and a forward direction described hereinafter are referred to as a front surface in the front of a cooking apparatus 1 shown in FIG. 1 and a direction in front of the cooking apparatus 1, and a rearward direction is referred to as a direction toward the rear of the cooking apparatus 1. Although a cooking apparatus according to one embodiment of the present disclosure is described in a built-in type and installed in a decoration cabinet, the cooking apparatus may also be applied to a cooking apparatus using a heater.

Figure 2:
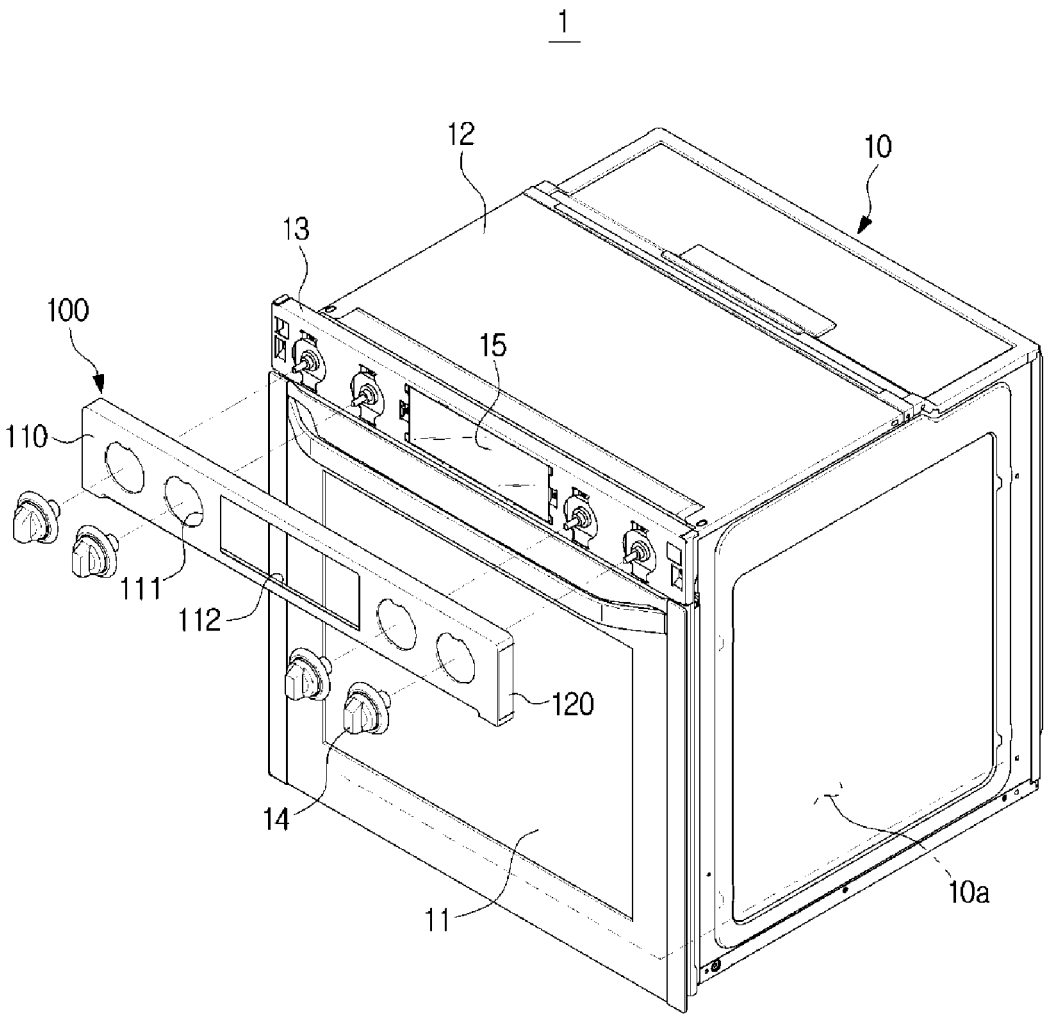
FIG. 2 is an exploded perspective view illustrating a control panel of the cooking apparatus according to one embodiment of the present disclosure.
Figure 3:
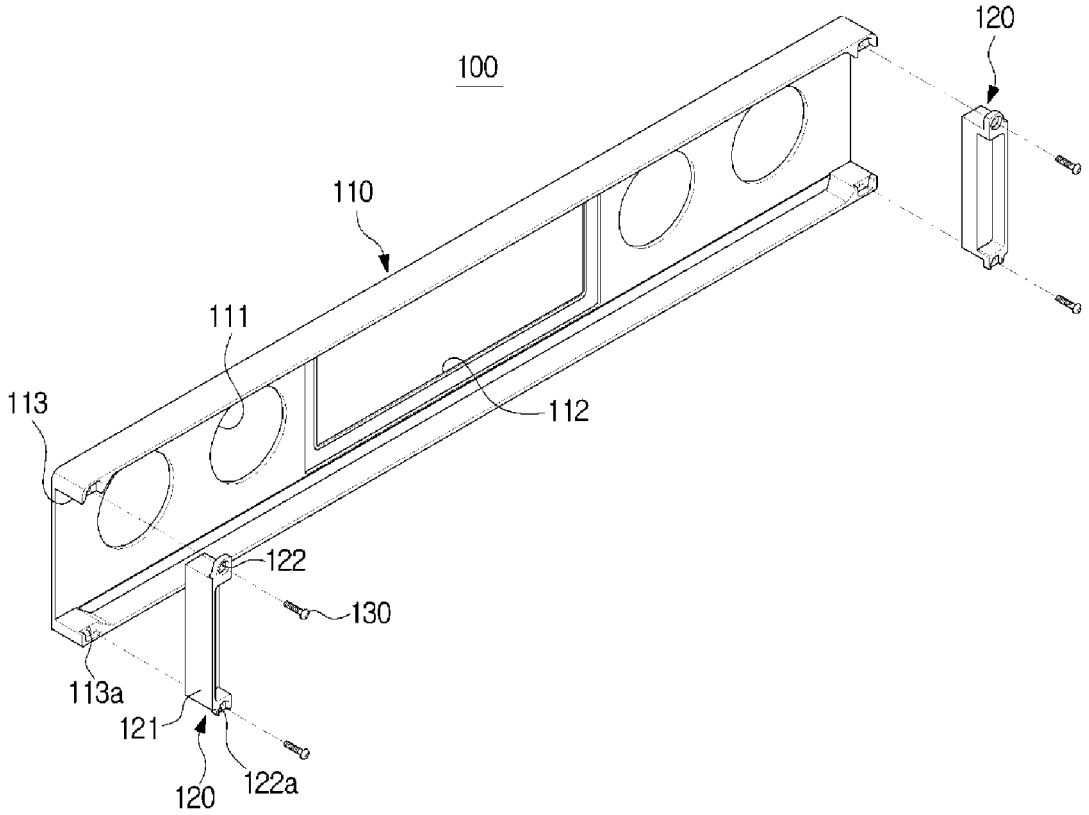
FIG. 3 is an exploded perspective view illustrating the control panel according to one embodiment of the present disclosure.

FIG. 1 is a perspective view illustrating the cooking apparatus according to one embodiment of the present disclosure, FIG. 2 is an exploded perspective view illustrating a control panel of the cooking apparatus according to one embodiment of the present disclosure, and FIG. 3 is an exploded perspective view illustrating the control panel according to one embodiment of the present disclosure.

As shown in FIGS. 1 to 3, the cooking apparatus 1 may be installed inside a piece of furniture, a wall, or a cabinet C to match a kitchen space. For example, the cabinet C in which the cooking apparatus 1 is installed includes an accommodating portion formed such that a front surface thereof is open. The cooking apparatus 1 may be accommodated inside the accommodating portion in the cabinet C.

The cooking apparatus 1 may include a body 10 forming a cooking chamber 10*a* provided to cook food, a door 11 formed in front of the body 10 and configured to selectively open or close the cooking chamber 10*a*, and a control panel 100 formed on one side of the body 10 and configured to perform an operation of the cooking apparatus 1. The control panel 100 may be disposed on an upper end of the front surface of the body 10 to receive an operation signal for operating the cooking chamber 10*a*. A machine room 12 in which a plurality of electronic components are provided may be provided behind the control panel 100.

The body 10 has a hexahedral shape with an open front surface, and the door 11 for opening or closing the open cooking chamber 10*a* may be installed on the open front surface. The door 11 is provided so that a lower end thereof is hinge-coupled to the body 10 and rotates to be opened or closed.

According to the embodiment of the present disclosure, although the cooking apparatus is exemplarily shown as an oven provided with a cooking chamber inside a body thereof, the spirit of the present disclosure is not limited thereto. For example, the cooking apparatus may include an integrated cooking apparatus in which a cooking chamber and a cooktop are integrally formed. Also, the spirit of the present disclosure is applicable to all household appliances on which a control panel is mounted.

The control panel 100 may be installed on the body 10. The control panel 100 may be installed in front of the body 10. The control panel 100 may be installed above the door 11. The control panel 100 may be installed on a control panel coupler 13 provided above the front surface of the body 10. The control panel coupler 13 may be provided above the front surface of the body 10. The control panel coupler 13 may be provided on one side of the machine room 12 provided above the body 10. The control panel coupler 13 may be provided on a front end of the machine room 12. The control panel 100 may be detachably coupled to the control panel coupler 13.

Levers 14 configured to operate the cooking apparatus 1 may be installed on the control panel 100 of the body 10. The levers 14 may be fixed to the control panel coupler 13 and connected to the machine room 12. According to the embodiment of the present disclosure, although the levers 14 are exemplarily shown as dials provided to be rotatable, the spirit of the present disclosure is not limited thereto. For example, the levers 14 may include buttons or touch panels.

A display panel 15 configured to display an operation state of the cooking apparatus 1 may be installed in the control panel 100. The display panel 15 may be provided at the control panel coupler 13.

The control panel 100 may include a first panel 110 and a second panel 120 coupled to the first panel 110. The first panel 110 may be referred to as a control panel, and the second panel 120 may be referred to as a control panel bracket.

The first panel 110 may include an aluminum (Al) material. The first panel 110 is provided so that at least one surface thereof is outwardly exposed. At least one surface of the first panel is provided to be exposed in front of the body 10. The first panel 110 may be formed in a plate shape.

The first panel 110 may include a first surface 110*a* provided to be exposed in front of the body 10, a second surface 110*b* formed at a side opposite the first surface 110*a*, and third surfaces 110*c* extending at upper and lower sides of the first surface 110*a* and the second surface 110*b*. The first surface 110*a*, the second surface 110*b*, and the third surfaces 110*c* may be integrally formed (see FIG. 4).

The first surfaces 110*a* of the first panel 110 may form a front surface of the control panel 100. The third surfaces 110*c* may form upper and lower surfaces of the control panel 100. The first panel 110 may be formed by an extrusion process. The first panel 110 may be formed to have a thickness of 3 mm or more.

The first panel 110 may be formed by at least one process of an extrusion process and a bending process.

The first panel 110 may include a plurality of installation holes 111 and 112 formed by opening at least a part of the first surface 110*a*. The installation holes 111 and 112 may include a plurality of first installation holes 111 and a second installation hole 112. The first installation holes 111 may be formed in a circular shape. The plurality of first installation holes 111 may be formed and disposed to be spaced apart at each of a left side and a right side of the first panel 110. Each of the levers 14 may be rotatably coupled to one of the first installation holes 111. The second installation hole 112 may be formed at the center of the first panel 110. The second installation hole 112 is provided so that the display panel 15 is installed therein. The second installation hole 112 may be formed in a quadrangular shape. The second installation hole 112 may be formed in a shape corresponding to the display panel 15. The first installation holes 111 and the second installation hole 112 of the first panel 110 may be formed by a cutting process.

According to the embodiment of the present disclosure, although two first installation holes 111 and two levers 14 installed in the first installation holes 111 are exemplarily shown to be provided on each of a left side and a right side of the display panel 15, the spirit of the present disclosure is not limited thereto. For example, the number of the first installation holes 111 may vary.

Meanwhile, second panel installation portions 113 to which the second panel 120 is coupled are formed on the first panel 110. The second panel installation portions 113 to which the second panel 120 is coupled are formed on the third surface 110*c* of the first panel 110. The second panel installation portion 113 may be formed on each of end portions of the first panel 110. The second panel installation portions 113 may be formed in a shape corresponding to the second panel 120. The second panel installation portion 113 may include a second panel fixing portion 113*a* so that the second panel 120 is fixed. The second panel fixing portion 113*a* may be formed on the third surface 110*c* of the first panel 110. The second panel fixing portion 113*a* may include holes to which coupling members 130 such as screws or the like are coupled. According to the embodiment of the present disclosure, although the second panel fixing portion 113*a* is exemplarily shown to include the holes to which the coupling members are coupled, the spirit of the present disclosure is not limited thereto. For example, the second panel fixing portion 113*a* may include at least one of a protrusion, a groove, and a hook.

The second panel 120 may include an aluminum (Al) material. The second panel 120 may be formed by an extrusion process. The second panel 120 may be formed by at least one process of the extrusion process and a bending process.

The second panel 120 is provided so that at least one surface thereof is outwardly exposed. At least one surface of the second panel 120 is provided to be exposed in a lateral direction of the body 10. The second panel 120 may be formed in a bar shape. A side surface of the second panel 120 may be provided to form a side surface of the first panel 110.

The second panel 120 includes a second panel body 121 and fixing portions 122 formed on the second panel body 121. The second panel body 121 may be formed in a rectangular parallelepiped shape. A side surface of the second panel body 121 may form the side surface of the first panel 110. The second panel 120 includes the fixing portions 122 to be fixed to the first panel 110. The fixing portions 122 are provided at an upper end portion and a lower end portion of the second panel 120 to fix the first panel 110. The fixing portions 122 may include fixing holes 122*a* to which the coupling members 130 are coupled.

Accordingly, the second panel 120 may be insertedly disposed in the second panel installation portion 113 of the first panel 110, and the second panel 120 and the first panel 110 may be fixed by the coupling members 130 passing through the fixing holes 122*a* of the second panel 120. A portion at which the first panel 110 and the second panel 120 are coupled is formed at a rear side of the control panel 100 and is not exposed outside the body 10, and accordingly, an exterior of the body can be improved.

Figure 4:
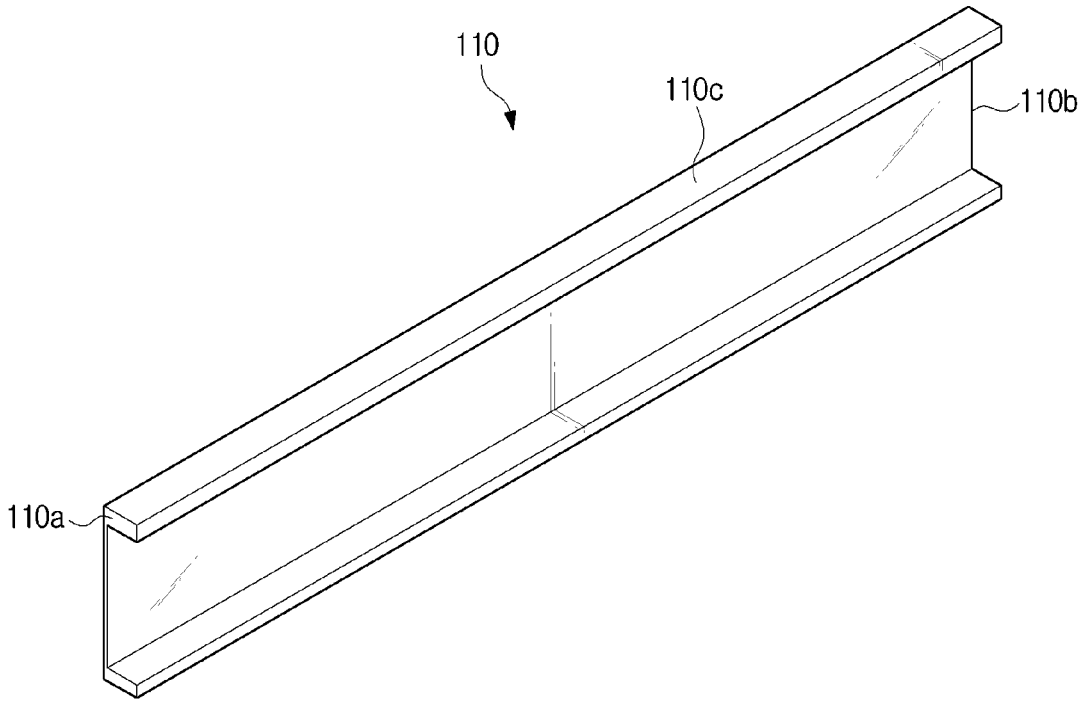
FIG. 4 is a view illustrating an aluminum extrusion process included in a method of manufacturing a control panel according to one embodiment of the present disclosure.
Figure 5:
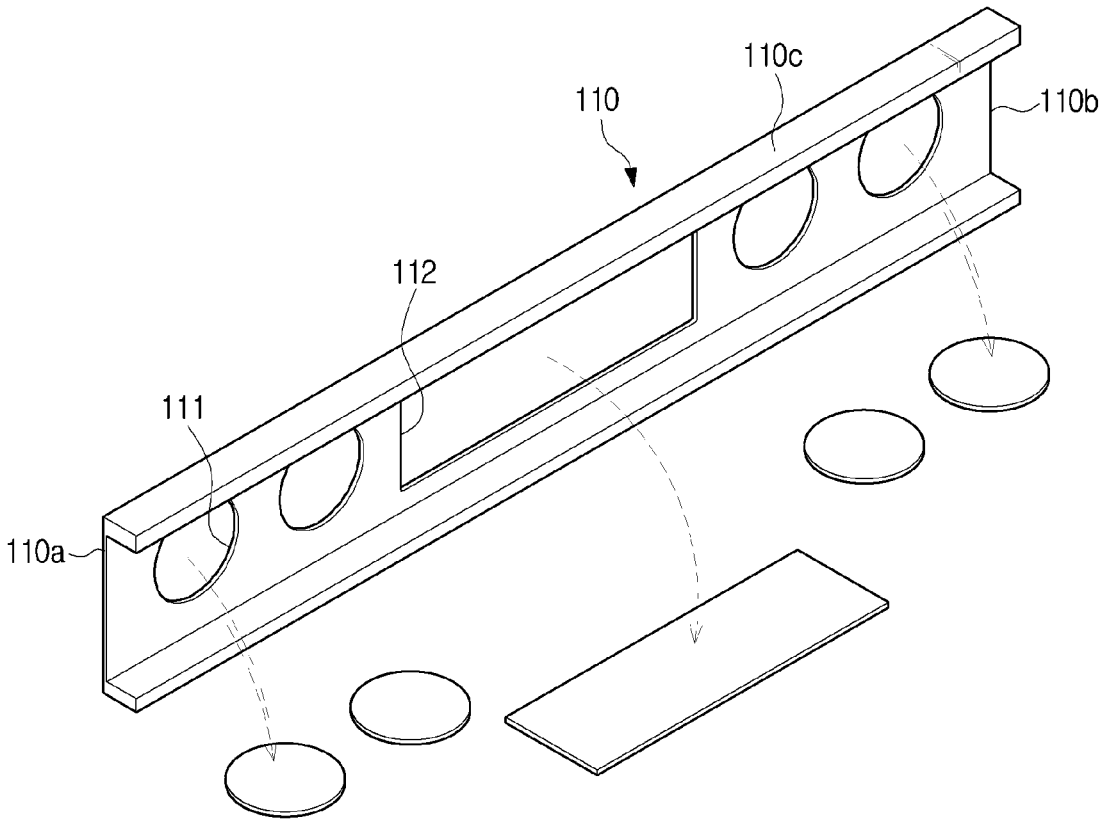
FIG. 5 is a view illustrating a cutting process included in the method of manufacturing a control panel according to one embodiment of the present disclosure.
Figure 6:
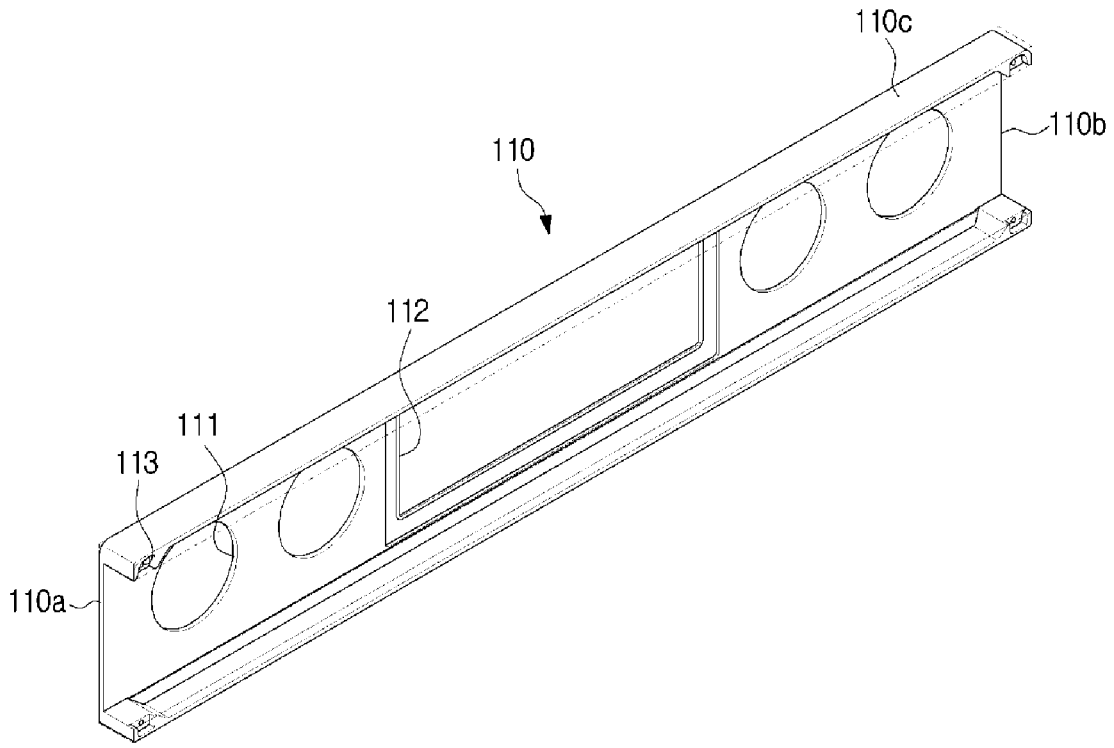
FIG. 6 is a view illustrating a computer numerical control (CNC) process included in the method of manufacturing a control panel according to one embodiment of the present disclosure.
Figure 7:
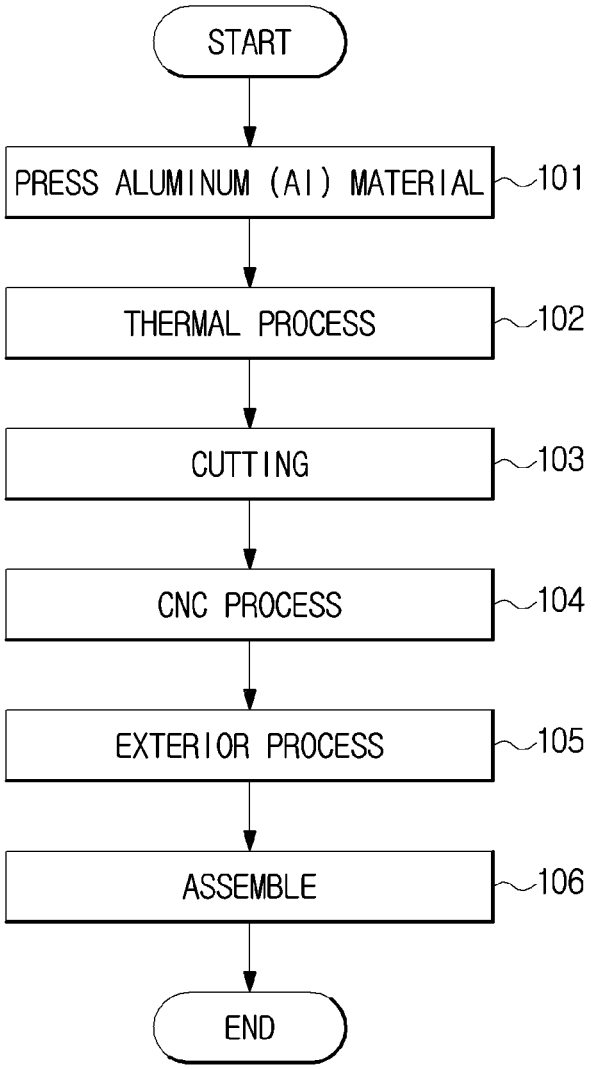
FIG. 7 is a flowchart illustrating the method of manufacturing a control panel according to one embodiment of the present disclosure.

FIG. 4 is a view illustrating an aluminum extrusion process included in a method for manufacturing the control panel according to one embodiment of the present disclosure, FIG. 5 is a view illustrating a cutting process included in the method for manufacturing the control panel according to one embodiment of the present disclosure, FIG. 6 is a view illustrating a computer numerical control (CNC) process included in the method for manufacturing the control panel according to one embodiment of the present disclosure, and FIG. 7 is a flowchart illustrating the method for manufacturing the control panel according to one embodiment of the present disclosure.

As shown in FIGS. 4 to 7, a method of manufacturing the control panel 100 will be described.

In order to form the control panel, an aluminum (Al) material is extruded to form the first panel 110 and the second panel 120. The first panel 110 and the second panel 120 may be formed by at least one process of processes of extruding the aluminum material and bending the aluminum material (101).

During the process of extruding or bending the aluminum material, the first panel 110 may form the first surface 110*a* forming a front surface of the control panel 100, the second surface 110*b* integrally provided with the first surface 110*a* on a rear of the first surface 110*a*, and the third surface 110*c* which is integrally formed with and bent from the first surface 110*a* and the second surface 110*b*.

At this time, the first surface 110*a* forms an exposed surface in the front of the control panel 100, and the second surface 110*b* may form an inner surface of the control panel 100 behind the first surface 110*a*. Also, the third surface 110*c* may form an upper or lower surface of the control panel 100.

Heat treatments are performed on the first panel 110 and the second panel 120 formed of the extruded aluminum material (102). Heat treatments under the same condition are performed on the first panel 110 and the second panel 120. At this time, a temperature of the heat treatment may be in a range of 180° C. to 200° C., and a time of the heat treatment may be 3.3 hours (HR).

The first panel 110 and the second panel 120 on which the heat treatments have been performed are cut (103). The plurality of the first installation holes 111 and the second installation hole 112 are formed in the first panel 110. The first installation holes 111 and the second installation hole 112 of the first panel 110 may be formed by a cutting process.

As shown in FIG. 6, the first panel 110 on which the cutting process has been performed may be formed in a shape including the second panel installation portions 113, the second panel fixing portions 113*a*, and the like by a CNC process (104).

After the first panel 110 is formed by the CNC process, the first panel 110 may be molded by an exterior process including a hairline process or anodizing process (105).

Meanwhile, since a process of manufacturing the second panel 120 is the same as that of manufacturing the first panel 110, a specific description thereof will be omitted.

In the manufactured first panel 110 and second panel 120, the second panel 120 is inserted into the second panel installation portion 113 of the first panel 110, and the coupling members 130 may pass through the fixing portions 122 of the second panel 120 to be coupled to the second panel fixing portion 113*a* of the first panel 110 (106).

At this time, the first panel 110 and the second panel 120 may be assembled through at least one method among welding, bonding, riveting, press-fitting, and screwing methods.

Meanwhile, since the manufactured first panel 110 and second panel 120 are formed by the same material and process, exteriors thereof can be improved by matching the materials and designs thereof each other.

Figure 8:
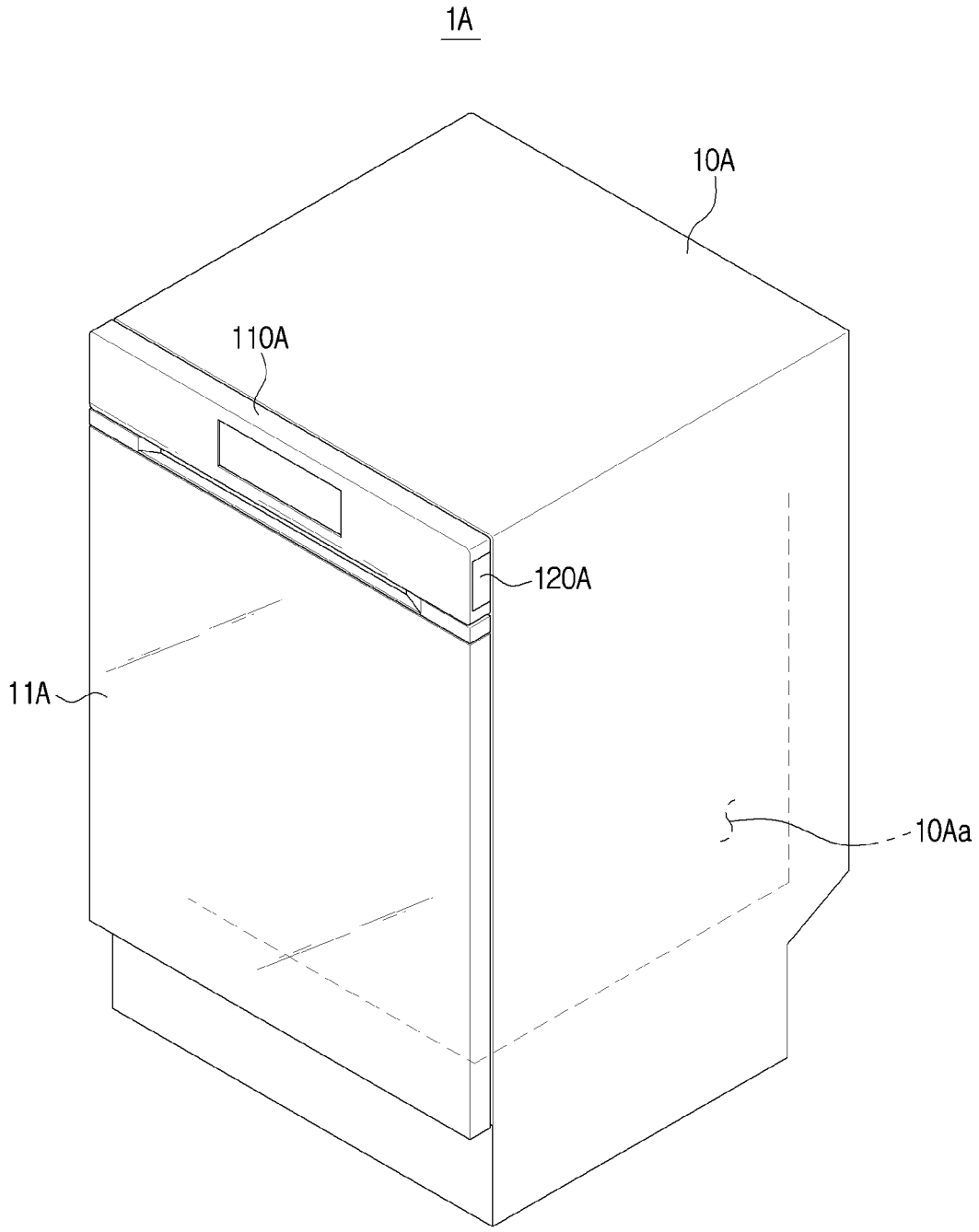
FIG. 8 is a perspective view illustrating a dishwasher to which the control panel according to one embodiment of the present disclosure is applied.

FIG. 8 is a perspective view illustrating a dishwasher to which the control panel according to one embodiment of the present disclosure is applied.

As shown in FIG. 8, a dishwasher 1A to which a control panel 110A is applied may include a body 10A, a wash tub 10Aa provided inside the body 10A and having a washing space, and a door 11A provided to selectively open or close the washtub 10Aa.

The door 11A is rotatably installed on a lower portion of the body 10A and is provided to open or close the wash tub 10Aa.

The control panel 110A may be mounted on an upper side of a front surface of the body 10A. The control panel 110A is formed by extruding an aluminum (Al) material. The control panel 110A may be formed by at least one process of processes of extruding the aluminum material and bending the aluminum material.

Further, a control panel bracket 120A may be coupled to the control panel 110A. The control panel bracket 120A may be formed by at least one process of processes of extruding the aluminum (Al) material and bending the aluminum (Al) material.

The control panel bracket 120A may be mounted on each end portion of the control panel 110A. Both side surfaces of the control panel bracket 120A may be formed to be exposed outside the control panel 110A.

The control panel 110A and the control panel bracket 120A after at least one process of an extrusion process and a bending process are subject to a heat treatment, a cutting process, and a CNC process, and then are remolded.

The control panel 110A and the control panel bracket 120A are molded by at least one process of a hairline process and an anodizing process after the CNC process, and then are assembled, so that the control panel 110A and control panel bracket 120A may be formed of the same material and process.

Accordingly, exteriors of the control panel 110A and control panel bracket 120A can be improved because designs thereof match each other.

As is apparent from the above description, the control panel can have improved durability by using an aluminum material, and can have an improved design by matching materials of the control panel.

Also, a process of manufacturing a control panel is simplified, thereby reducing a production time and costs.

Although a few embodiments of the present disclosure have been shown and described, it should be appreciated by those skilled in the art that changes may be made in these embodiments without departing from the principles and spirit of the disclosure, and the scope of which is defined in the claims and their equivalents.

What is claimed is:

1. A household appliance comprising:

a body; and a control panel provided on an outer side of the body, wherein the control panel includes:

a first extruded aluminum panel extending lengthwise in a first direction and provided with at least one surface of the extruded aluminum panel exposed to an exterior of the household appliance, and including a front surface facing away from the body and a rear surface facing the body in a second direction perpendicular to the first direction; and a second extruded aluminum panel provided to be coupled to the rear surface of the first panel by at least one fastener extending through the second extruded aluminum panel in the second direction, wherein the second extruded aluminum panel is exposed to the exterior of the household appliance in the first direction, wherein the at least one fastener is provided between the first extruded aluminum panel and the body in the second direction such that the at least one fastener is covered by the body in the second direction when the control panel is provided on the outer side of the body, and wherein the first extruded aluminum panel includes a top portion extending from a top of the first extruded aluminum panel in the second direction to cover a top of the second extruded aluminum panel in a third direction perpendicular to the first direction and the second direction.

2. The household appliance according to claim 1, wherein the first panel further includes a bent aluminum portion.

3. The household appliance according to claim 1, wherein the first panel and the second panel are coupled by at least one method among a welding, bonding, riveting, press-fitting, and screwing method.

4. The household appliance according to claim 1, wherein the first extruded aluminum panel includes:

a plurality of first installation holes configured to receive levers mounted on the first extruded aluminum panel; and a second installation hole configured to receive a display panel on the first extruded aluminum panel.

5. The household appliance according to claim 1, wherein the first extruded aluminum panel further includes a second extruded aluminum panel coupler formed to be coupled to the second extruded aluminum panel.

6. The household appliance according to claim 1, wherein the first extruded aluminum panel is sequentially subject to a heat treatment, a cutting process, and a computer numerical control (CNC) process, and then is remolded.

7. The household appliance according to claim 6, wherein the first extruded aluminum panel is remolded by performing at least one of a hairline process and an anodizing process, after performing the CNC process.

8. The household appliance according to claim 1, wherein the second extruded aluminum panel is sequentially subject to a heat treatment, a cutting process, and a computer numerical control (CNC) process, and then is remolded.

9. The household appliance according to claim 8, wherein the second extruded aluminum panel is remolded by performing at least one of a hairline process and an anodizing process after performing the CNC process.

10. A cooking apparatus comprising:

a body including a cooking chamber;

a control panel provided on an outer side of the body, extending lengthwise in a first direction and provided with an extruded aluminum surface exposed to an exterior of the cooking apparatus, and including a front surface facing away from the body and a rear surface facing the body in a second direction perpendicular to the first direction; and a plurality of extruded aluminum control panel brackets provided to be respectively coupled to a respective rear surface of end portions of the control panel by at least one respective fastener extending through the plurality of extruded aluminum control panel brackets in the second direction, wherein the plurality of extruded aluminum control panel brackets are exposed to the exterior of the cooking apparatus in the first direction, wherein the at least one respective fastener is provided between the rear surface and the body in the second direction such that the at least one respective fastener is covered by the body in the second direction when the control panel is provided on the outer side of the body, and wherein the control panel includes a top portion extending from a top of the control panel in the second direction to cover a top of the plurality of extruded aluminum control panel brackets in a third direction perpendicular to the first direction and the second direction.

11. The cooking apparatus according to claim 10, wherein at least one of the extruded aluminum surface of the control panel and the plurality of extruded aluminum control panel brackets further include a bent aluminum portion.

12. The cooking apparatus according to claim 10, wherein each of the plurality of extruded aluminum control panel brackets include:

a bracket body; and a fixing portion formed on an end portion of the bracket body.

13. The cooking apparatus according to claim 10, wherein the extruded aluminum surface of the control panel and the plurality of extruded aluminum control panel brackets are coupled through at least one method among a welding, bonding, riveting, press-fitting, and screwing method.

14. The cooking apparatus according to claim 10, wherein the extruded aluminum surface of the control panel includes:

a plurality of first installation holes configured to receive levers; and a second installation hole configured to receive a display panel.

15. The cooking apparatus according to claim 10, wherein the extruded aluminum surface of the control panel and the plurality of extruded aluminum control panel brackets are sequentially subject to a heat treatment, a cutting processing, and a computer numerical control (CNC) process, and then are remolded.

16. The cooking apparatus according to claim 15, wherein the extruded aluminum surface of the control panel is formed by at least one of a hairline process and an anodizing process, after performing the CNC process.

17. The cooking apparatus according to claim 15, wherein the plurality of extruded aluminum control panel brackets are formed by performing at least one of a hairline process and an anodizing process, after performing the CNC process.

18. A method of manufacturing the household appliance of claim 1, the method comprising:

extruding an aluminum material to form the first panel;

extruding the aluminum material to form the second panel;

performing a heat treatment on the first panel and the second panel;

cutting the first panel to form a plurality of installation holes in the first panel;

performing a computer numerical control (CNC) process on the first panel and the second panel; and coupling the first panel to the second panel.

19. The method according to claim 18, wherein the first panel and the second panel are formed by at least one of a hairline process and an anodizing process.

20. The method according to claim 18, wherein the first panel and the second panel are coupled by at least one method among a welding, bonding, riveting, press-fitting, and screwing method.

* * * * *